US009841023B2

(12) United States Patent
Tanaka

(10) Patent No.: US 9,841,023 B2
(45) Date of Patent: Dec. 12, 2017

(54) VACUUM PUMP

(71) Applicant: Nabtesco Automotive Corporation, Tokyo (JP)

(72) Inventor: Katsunori Tanaka, Tokyo (JP)

(73) Assignee: NABTESCO AUTOMOTIVE CORPORATION, Tokyo (JP)

( * ) Notice: Subject to any disclaimer, the term of this patent is extended or adjusted under 35 U.S.C. 154(b) by 16 days.

(21) Appl. No.: 14/402,651

(22) PCT Filed: May 21, 2013

(86) PCT No.: PCT/JP2013/064113
§ 371 (c)(1),
(2) Date: Nov. 20, 2014

(87) PCT Pub. No.: WO2013/176143
PCT Pub. Date: Nov. 28, 2013

(65) Prior Publication Data

US 2015/0110661 A1 Apr. 23, 2015

(30) Foreign Application Priority Data

May 21, 2012 (JP) ..... 2012-115804
May 22, 2012 (JP) ..... 2012-116479

(51) Int. Cl.
*F01C 19/08* (2006.01)
*F01C 19/10* (2006.01)
(Continued)

(52) U.S. Cl.
CPC ..... *F04C 25/02* (2013.01); *F01C 21/108* (2013.01); *F04C 18/3441* (2013.01);
(Continued)

(58) Field of Classification Search
CPC .... F01C 21/108; F04C 18/3441; F04C 25/62; F04C 29/0078
(Continued)

(56) References Cited

U.S. PATENT DOCUMENTS 2,437,791 A * 3/1948 Roth ..... F04C 14/265 137/115.13
3,059,580 A * 10/1962 Farrell ..... B62D 5/062 417/300
(Continued)

FOREIGN PATENT DOCUMENTS

CN 2402838 Y 10/2000
CN 200993102 Y 12/2007
(Continued)

OTHER PUBLICATIONS

English translation of International Preliminary Report on patentability (Chanpter 1) issued in PCT/JP2013/064113 dated Dec. 4, 2014.
(Continued)

*Primary Examiner* — Mark Laurenzi
*Assistant Examiner* — Deming Wan
(74) *Attorney, Agent, or Firm* — McDermott Will & Emery LLP

(57) ABSTRACT

Durability of a vacuum pump is prevented from degrading by suppressing abrasion of a rotor and a side plate. The vacuum pump has a hollow cylinder chamber S having an opening at an end portion of a casing body, a rotor which is rotationally driven in the cylinder chamber S, a side plate for blocking the opening of the cylinder chamber S, and a pump cover which is disposed at the opposite side to the rotor so as to sandwich the side plate between the pump cover and the rotor, and the side plate is provided with an intercommunication port which confronts a shaft hole of the rotor and
(Continued)

intercommunicates with a space between the side plate and the pump cover.

9 Claims, 8 Drawing Sheets

(51) Int. Cl.

| | |
|---|---|
| ***F04C 2/344*** | (2006.01) |
| ***F04C 15/06*** | (2006.01) |
| ***F01C 21/18*** | (2006.01) |
| ***F04C 18/324*** | (2006.01) |
| ***F04C 25/02*** | (2006.01) |
| ***F01C 21/10*** | (2006.01) |
| ***F04C 27/00*** | (2006.01) |
| ***F04C 29/00*** | (2006.01) |
| ***F04C 18/344*** | (2006.01) |

(52) U.S. Cl.
CPC ..... *F04C 27/006* (2013.01); *F04C 29/0078* (2013.01); *F04C 2220/10* (2013.01)

(58) Field of Classification Search
USPC ..... 418/131, 259, 266–268, 181; 417/312, 417/540
See application file for complete search history.

(56) References Cited

U.S. PATENT DOCUMENTS

| | | | | |
|---|---|---|---|---|
| 3,399,627 | A * | 9/1968 | Jeep, Jr. | F02M 37/045 417/310 |
| 3,656,870 | A * | 4/1972 | Kusakabe | F04C 14/26 417/300 |
| 3,822,965 | A * | 7/1974 | Drutchas | F04C 15/062 417/283 |
| T927,009 | I4 * | 10/1974 | Ulrich | F04C 14/26 418/133 |
| 5,100,308 | A | 3/1992 | Gevelhoff et al. | |
| 5,171,131 | A * | 12/1992 | Niemiec | F04C 15/06 417/283 |
| 5,571,004 | A * | 11/1996 | Masters | F01C 21/102 418/107 |
| 5,683,229 | A * | 11/1997 | Stoll | F01C 21/02 417/366 |
| 6,491,501 | B1 | 12/2002 | Wild et al. | |
| 8,186,983 | B2 * | 5/2012 | Kano | F04C 18/3442 418/133 |
| 2004/0213680 | A1 * | 10/2004 | Suzuki | F04C 2/18 417/310 |
| 2004/0253134 | A1 | 12/2004 | Bohr | |
| 2013/0101412 | A1 | 4/2013 | Mitsuhashi et al. | |

FOREIGN PATENT DOCUMENTS

| | | | |
|---|---|---|---|
| CN | 101709700 | A | 5/2010 |
| CN | 102062094 | A | 5/2011 |
| DE | 3906823 | B4 | 1/2004 |
| FR | 2869958 | A1 | 11/2005 |
| JP | 57-196847 | A | 12/1982 |
| JP | 2003-254244 | A | 9/2003 |
| JP | 2009-091973 | A | 4/2009 |
| JP | 2011-214519 | A | 10/2011 |
| WO | 2011/126032 | A2 | 10/2011 |

OTHER PUBLICATIONS

International Search Report issued in Application No. PCT/JP2013/064113 dated Aug. 13, 2013.
First Office Action issued in Chinese Patent Application No. 201380026931.2, dated Feb. 29, 2016; with English translation.
Partial Supplementary European Search Report issued in corresponding EP 13793592.0, dated Mar. 4, 2016.
Notification of Reasons for Refusal issued in corresponding Japanese Patent Application No. 2012-115804, dated Mar. 22, 2016; with English translation.
Extended European Search Report issued in corresponding European Patent Application No. 13793592.0, dated Jun. 20, 2016.
Notification of Reasons for Refusal issued in corresponding Japanese Patent Application No. 2012-115804, dated Sep. 6, 2016; with English translation.
Notification of Reasons for Refusal issued in corresponding Japanese Patent Application No. 2016-091025, dated Feb. 28, 2017; with English translation.
First Office Action issued in corresponding Chinese Patent Application No. 201610375979.X, dated Aug. 28, 2017; with English translation.

* cited by examiner

VACUUM PUMP

CROSS-REFERENCE TO RELATED APPLICATIONS

The present application is the U.S. National Phase of PCT/JP2013/064113 filed May 21, 2013, which claims priority to Japanese Patent Application No. 2012-115804 filed May 21, 2012, which claims priority to Japanese Patent Application No. 2012-116479 filed May 22, 2012. The disclosures of the above applications are incorporated herein by reference.

TECHNICAL FIELD

The present invention relates to a vacuum pump having a rotor secured to a rotating shaft of a driving machine.

BACKGROUND ART

There is generally known a vacuum pump having a casing body secured to a driving machine, a hollow cylinder chamber which is formed in the casing body and has an opening at an end portion of the casing body, a rotor which is rotationally driven in the cylinder chamber, a side plate which blocks the opening of the cylinder chamber, and a pump cover which is disposed at the opposite side of the rotor so as to sandwich the side plate between the pump cover and the rotor and fixed to the casing body. This type of vacuum pump is used to generate vacuum for actuating a power braking device of a vehicle, for example, and it can obtain vacuum by driving a rotor in a cylinder chamber of a casing with a driving machine such as an electric motor or the like (see Patent Document 1, for example).

PRIOR ART DOCUMENT

Patent Document 1: U.S. Pat. No. 6,491,501

SUMMARY OF THE INVENTION

Problem to be Solved by the Invention

In the conventional construction, the space formed between the side plate and the pump cover is under ambient pressure, whereas the vicinity of a shaft hole of the rotor which faces the side plate intercommunicates with a space under negative pressure occurring during operation of the vacuum pump through the gap between the rotor and the side plate, so that the vicinity of the shaft hole is set to ambient pressure or less (that is, negative pressure) in some cases.

Therefore, for example when the side plate is formed of a material having low rigidity such as carbon or the like, the side plate sags due to pressure difference, and the rotor and the side plate are brought into contact with each other during operation of the vacuum pump. Therefore, there has been assumed a problem that the rotor and the side plate are worn away and the durability of the vacuum pump is degraded.

The present invention has been implemented in view of the foregoing situation, and has an object to suppress abrasion of a rotor and a side plate with a simple construction, thereby preventing degradation of durability of a vacuum pump.

Means of Solving the Problem

In order to attain the above object, according to the present invention, a vacuum pump including a casing body having a hollow cylinder chamber opened at an end portion thereof, a rotor rotated in the cylinder chamber, a side plate which blocks the opening of the cylinder chamber, and a pump cover which is disposed at the opposite side to the rotor so as to sandwich the side plate between the pump cover and the rotor and fixed to the casing body, is characterized in that the side plate is provided with an intercommunication port that faces a shaft hole of the rotor and intercommunicates with a space between the side plate and the pump cover.

According to this construction, the side plate is provided with the intercommunication port which confronts the shaft hole of the rotor and intercommunicates with the space between the side plate and the pump cover, and thus the pressure difference between the neighborhood of the shaft hole of the rotor and the space can be suppressed. Therefore, the contact between the rotor and the side plate can be prevented, whereby the abrasion of the rotor and the side plate can be suppressed and the durability of the vacuum pump can be enhanced.

In this construction, the intercommunication port may be formed to be smaller than the shaft diameter of the rotating shaft for rotating the rotor. According to this construction, the amount of air flowing through the intercommunication port can be suppressed, and thus the compressibility when the rotor is rotated can be prevented from being reduced, so that degradation of the performance of the vacuum pump can be prevented.

Furthermore, the intercommunication port may be formed on the axial center of the shaft hole of the rotor. According to this construction, the intercommunication port is provided at the position which has the least influence on compression and expansion when the rotor is rotated. Therefore, the reduction of the compressibility when the rotor is rotated can be prevented, and the degradation of the performance of the vacuum pump can be prevented.

Furthermore, a seal member through which an exhaust passage from the cylinder chamber to the outside thereof and the space are isolated from each other may be disposed around the cylinder chamber between the casing body and the pump cover. According to this construction, exhausted air can be prevented from flowing into the space by the seal member, and thus the contact between the rotor and the side plate can be surely prevented.

According to the present invention, a vacuum pump having a rotating and compressing element driven by a motor in a casing is characterized in that the casing has a cylinder liner in which the rotating and compressing element slides, and a bearing portion for supporting a rotating shaft of the motor, and is secured to an opening portion of a cylindrical motor case body having a bottom.

According to this construction, the casing has the cylinder liner in which the rotating and compressing element slides, and the bearing portion for supporting the rotating shaft of the motor, and is secured to the opening portion of the cylindrical motor case body having the bottom. Therefore, the positional relationship between the cylinder liner and the rotating and compressing element can be regulated by only the casing. Therefore, misalignment occurring when the casing and the electric motor are assembled can be suppressed, and substantially uniform performance can be exercised with little individual difference. Furthermore, the casing can be formed by a single mold, so that the number of parts can be reduced and the manufacturing cost can be reduced.

In this construction, the casing has the bore portion in which the cylinder liner is disposed, and the bore portion may be a stepped bore which is reduced in diameter from the open end to the depth side. According to this construction, when the cylinder liner is disposed in the bore portion, the cylinder liner can be easily positioned because the end portion of the cylinder liner abuts against the step portion of the stepped bore.

The bore diameter of the diameter-reduced portion of the stepped bore may be set to be larger than the inner diameter of the cylinder liner. According to this construction, the side plate which is larger than the inner diameter of the cylinder liner can be disposed at the diameter-reduced portion, and the opening of the cylinder liner can be easily blocked by the side plate.

Effect of the Invention

According to the present invention, the side plate is provided with the intercommunication port which confronts the shaft hole of the rotor and intercommunicates with the space between the side plate and the pump cover, and thus the pressure difference between the neighborhood of the shaft hole of the rotor and the space can be suppressed. Therefore, the contact between the rotor and the side plate is prevented, whereby the abrasion of the rotor and the side plate can be suppressed and the durability of the vacuum pump can be enhanced.

According to the present invention, the casing has the cylinder liner in which the rotating and compressing element slides, and the bearing portion for supporting the rotating shaft of the motor, and is secured to the opening portion of the cylindrical motor case body having the bottom. Therefore, the positional relationship between the cylinder liner and the rotating and compressing element can be regulated by only the casing. Therefore, misalignment occurring when the casing and the electric motor are assembled can be suppressed, and substantially uniform performance can be exercised with little individual difference. Furthermore, the casing can be formed by a single mold, so that the number of parts can be reduced and the manufacturing cost can be reduced.

MODE FOR CARRYING OUT THE INVENTION

Preferred embodiments according to the present invention will be described hereunder with reference to the accompanying drawings.

First Embodiment

Figure 1:
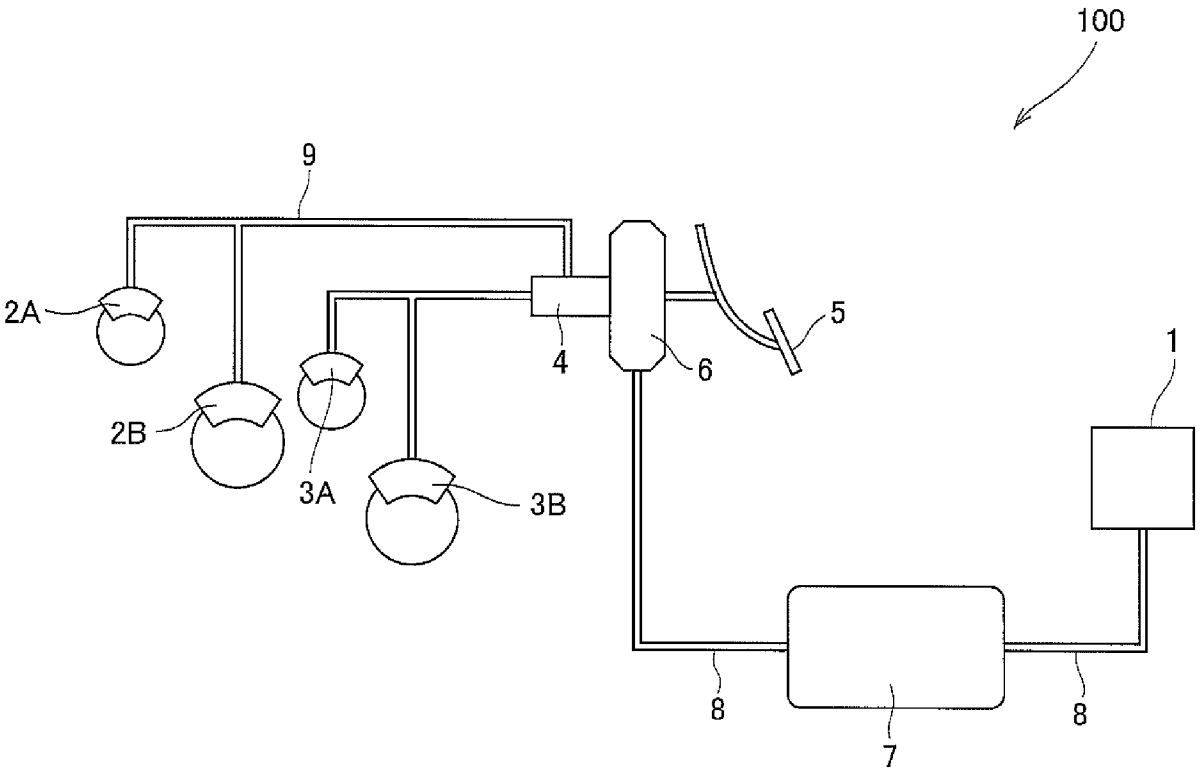
FIG. 1 is a diagram showing a brake device using a vacuum pump according to an embodiment.

FIG. 1 is a diagram showing a brake device 100 in which a vacuum pump 1 according to an embodiment of the present invention is used as a negative pressure source. The brake device 100 has front brakes 2A, 2B secured to the right and left front wheels of a vehicle such as a car or the like, and rear brakes 3A, 3B secured to the right and left rear wheels. Each of these brakes is connected to a master cylinder 4 and a brake pipe 9, and actuated with hydraulic pressure fed from the master cylinder 4 through the brake pipe 9.

Furthermore, the brake device 100 has a brake booster (power braking device) 6 connected to the brake pedal 5, and a vacuum tank 7 and the vacuum pump 1 are connected to the brake booster 6 through an air pipe 8 in series. The brake booster 6 boosts tread force of a brake pedal 5 by using the negative pressure in the vacuum tank 7, and it is configured to derive sufficient brake force by moving a piston (not shown) of the master cylinder 4 with small tread force.

The vacuum pump 1 is disposed in an engine room of the vehicle, and it discharges air in the vacuum tank 7 to the outside of the vehicle to set the inside of the vacuum tank 7 to a vacuum state. The use range of the vacuum pump 1 used for a car or the like is from −60 kPa to −80 kPa, for example.

Figure 2:
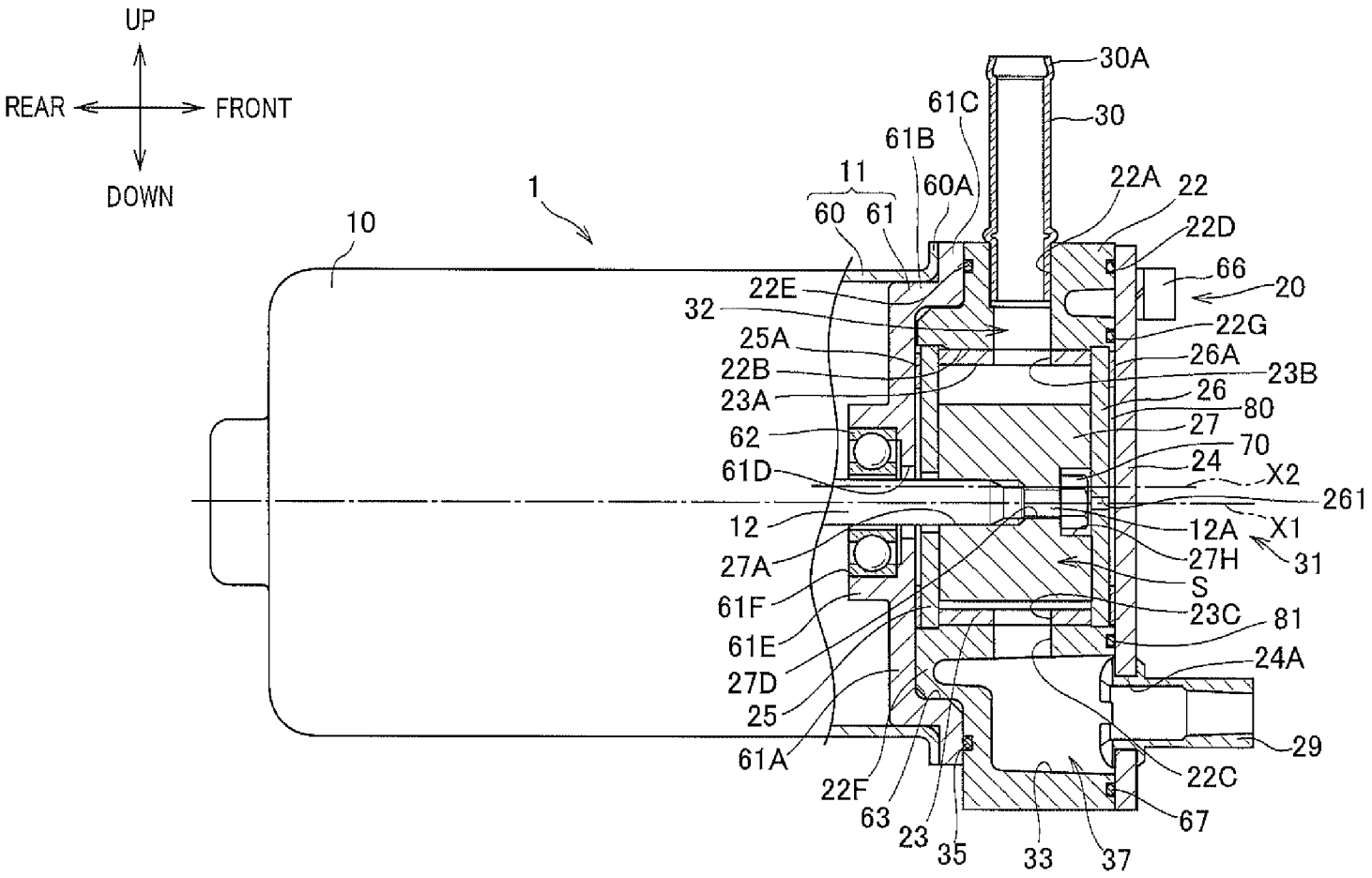
FIG. 2 is a partially sectional view of a side portion of the vacuum pump.
Figure 3:
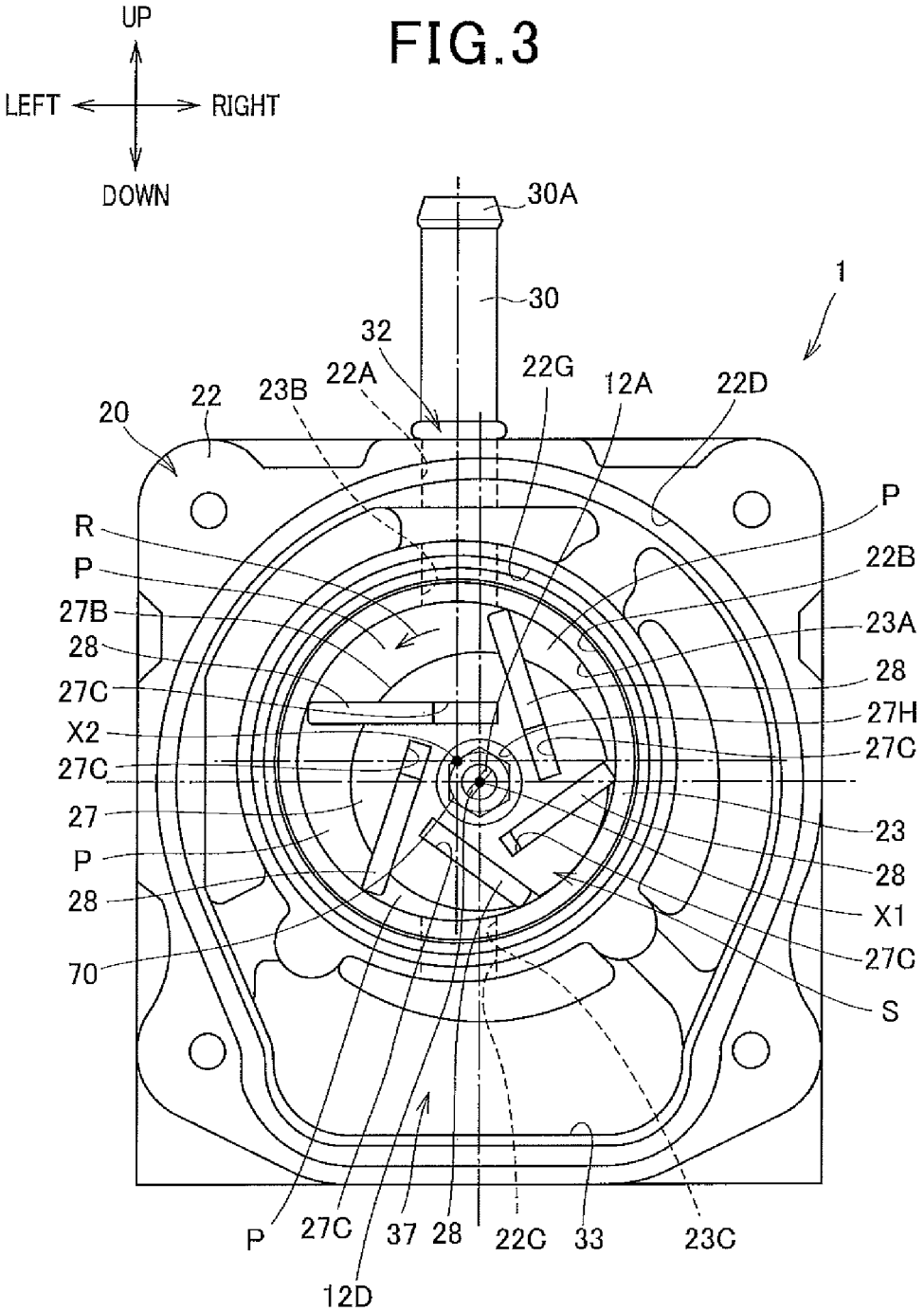
FIG. 3 is a diagram showing the vacuum pump when the vacuum pump is viewed from the front side thereof.

FIG. 2 is a partially sectional view of the side portion of the vacuum pump 1, and FIG. 3 is a diagram showing the vacuum pump 1 when the vacuum pump 1 of FIG. 2 is viewed from the front side thereof (the right side in FIG. 2). However, FIG. 3 shows a state that the members such as the pump cover 24, the side plate 26, etc. are detached to show the construction of a cylinder chamber S. In the following description, the directions represented by arrows at the upper portion of FIGS. 2 and 3 represent upper, lower, front, rear, right and left sides of the vacuum pump 1 for convenience of description. The front-and-rear direction is also referred to as "axial direction", and the right-and-left direction is also referred to as "width direction".

As shown in FIG. 2, the vacuum pump 1 has an electric motor (driving machine) 10, and a pump body 20 which is actuated by the electric motor 10 as a driving source. The vacuum pump 1 is fixed and supported in a vehicle body such as a car or the like while the electric motor 10 and the pump body 20 are integrally connected to each other.

The electric motor 10 has an output shaft (rotating shaft) 12 which extends from substantially the center of one end portion (front end) of a case 11 configured in a substantially cylindrical shape to the pump body 20 side (front side). The output shaft 12 functions as a driving shaft for driving the pump body 20, and rotates around the rotational center X1 extending in the front-and-rear direction. A rotor 27 of the pump body 20 is integrally rotatably connected to a tip portion 12A of the output shaft 12.

When the electric motor 10 is powered by a power source (not shown), the output shaft 12 rotates in the direction of an arrow R (counterclockwise) in FIG. 3, whereby the rotor 27 is rotated in the same direction (the direction of the arrow R) around the rotational center X1.

The case 11 has a case body 60 having a bottom which is configured in a cylindrical shape, and a cover body 61 for blocking the opening of the case body 60. The case body 60 is configured so that the peripheral edge portion 60A of the opening is bent outwards. The cover body 61 has a disc plate portion 61A which is formed to have substantially the same diameter as the opening of the case body 60, a cylindrical portion 61B which annually extends from the peripheral edge of the disc plate portion 61A in the axial direction and is fitted to the inner peripheral surface of the case body 60, and a bent portion 61C which is formed by bending the peripheral edge of the cylindrical portion 61B outwards, the disc plate portion 61A, the cylindrical portion 61B and the bent portion 61 being formed integrally with one another.

The disc plate portion 61A and the cylindrical portion 61B enter the inside of the case body 60, and the bent portion 61C is fixed in contact with the peripheral edge portion 60A of the case body 60. Accordingly, in the electric motor 10, one end portion (front end) of the case 11 is recessed inwards, and a fitting bore portion 63 to which the pump body 20 is faucet-fitted is formed.

A through hole 61D through which the output shaft 12 penetrates, and an annular bearing holding portion 61E extending to the inside of the case body 60 around the through hole 61D are formed substantially at the center of the disc plate portion 61A, and an outer ring of the bearing 62 which pivotally supports the output shaft 12 is held by the inner peripheral surface 61F of the bearing holding portion 61E.

As shown in FIG. 2, the pump body 20 has the casing body 22 fitted in the fitting bore portion 63 formed at the front side of the case 11 of the electric motor 10, a cylinder portion 23 which is integrally casted in the casing body 22 to form a cylinder chamber S, and a pump cover 24 which covers the casing body 22 from the front side. In this embodiment, a casing 31 of the vacuum pump 1 is constructed to have the casing body 22, the cylinder portion 23 and the pump cover 24.

The casing body 22 is formed of metal material having high thermal conductivity such as aluminum or the like and configured in a substantially rectangular shape which is longer in the up-and-down direction with the rotational center X1 being located substantially at the center of the shape in front view. An intercommunication hole 22A which intercommunicates with the cylinder chamber S provided to the casing body 22 is formed at the upper portion of the casing body 22, and a vacuum suction nipple 30 is press-fitted in the intercommunication hole 22A. As shown in FIG. 2, the vacuum suction nipple 30 is a straight pipe extending upwards, and a pipe or tube for supplying negative-pressure air from external equipment (for example, the vacuum tank 7 (see FIG. 1)) is connected to one end 30A of the vacuum suction nipple 30.

A hole portion 22B extending in the front-and-rear direction is formed in the casing body 22 based on an axial center X2, and the cylinder portion 23 formed in a cylindrical shape is integrally casted in the hole portion 22B. Specifically, under the state that the cylinder portion (cylinder liner) 23 is set in a mold, teeming into the mold is performed to cast the casing body 22 (casing 31) in which the cylinder portion 23 is integrally casted. In this embodiment, the cylinder portion 23 is integrally casted in the casing body 22. However, the present invention is not limited to this style, and the cylinder portion 23 may be press-fitted in the hole portion 22B of the casing body 22 which has been casted in advance.

The axial center X2 is parallel to the rotational center X1 of the output shaft 12 of the electric motor 10, and eccentrically displaced from the rotational center X1 to the upper left side as shown in FIG. 2. In this construction, the axial center X2 is eccentrically displaced so that the outer peripheral surface 27B of the rotor 27 having the rotational center X1 as the center makes contact with the inner peripheral surface 23A of the cylinder portion 23 which is formed based on the axial center X2.

The cylinder portion 23 is formed of the same metal material (iron in this embodiment) as the rotor 27. In this construction, the cylinder portion 23 and the rotor 27 have the same thermal expansion coefficient. Therefore, the contact between the outer peripheral surface 27B of the rotor 27 and the inner peripheral surface 23A of the cylinder portion 23 when the rotor 27 is rotated can be prevented irrespective of temperature variation of the cylinder portion 23 and the rotor 27. The cylinder portion 23 and the rotor 27 may be formed of different materials insofar as these materials are metal materials having substantially the same thermal expansion coefficient.

The cylinder portion 23 is integrally casted in the hole portion 22B formed in the casing body 22, whereby the cylinder portion 23 can be accommodated within the length range of the casing body 22 in the front-and-rear direction. Therefore, the cylinder portion 23 can be prevented from protruding from the casing body 22, and the casing body 22 can be miniaturized.

Furthermore, the casing body 22 is formed of a material having higher thermal conductivity than the rotor 27. Accordingly, heat occurring when the rotor 27 and vanes 28 are rotated can be quickly transferred to the casing body 22, so that heat can be sufficiently radiated from the casing body 22.

An opening 23B through which the intercommunication hole 22A of the casing body 22 intercommunicates with the cylinder chamber S is formed in the cylinder portion 23, and air passing through the vacuum suction nipple 30 is supplied through the intercommunication hole 22A and the opening 23B into the cylinder chamber S. Therefore, in this embodiment, an air-intake passage 32 is configured to have the vacuum suction nipple 30, the intercommunication hole 22A of the casing body 22 and the opening 23B of the cylinder portion 23. Discharge ports 22C, 23C which penetrate through the casing body 22 and the cylinder portion 23 and through which air compressed in the cylinder chamber S is discharged are provided at the lower portions of the casing body 22 and the cylinder portion 23.

Side plates 25, 26 for blocking the openings of the cylinder chamber S are disposed at the rear and front ends of the cylinder portion 23. These side plates 25, 26 are configured so that the diameters thereof are larger than the inner diameter of the inner peripheral surface 23A of the cylinder portion 23, and urged to be pressed against the front end and rear end of the cylinder portion 23 by seal rings 25A, 26A. Accordingly, the cylinder chamber S which is hermetically closed except for the opening 23B intercommunicating with the vacuum suction nipple 30 and the discharge ports 23C, 22C is formed inside the cylinder portion 23.

The rotor 27 is disposed in the cylinder chamber S. The rotor 27 has a columnar shape extending along the rotational center X1 of the electric motor 10, and has a shaft hole 27A in which the output shaft 12 as the driving shaft of the pump body 20 is inserted. Plural guide grooves 27C are provided at positions of the rotor 27 which are away from the shaft hole 27A in the radial direction and spaced from one another at regular angular intervals in the peripheral direction around the shaft hole 27A.

The length in the front-and-rear direction of the rotor 27 is set to be substantially equal to the length of the cylinder chamber S of the cylinder portion 23, that is, the distance between the confronting inner surfaces of the two side plates 25, 26, and the gap between the rotor 27 and each of the side plates 25, 26 is substantially closed.

The outer diameter of the rotor 27 is set so that the outer peripheral surface 27 of the rotor 27 keeps a minute clearance from a portion of the inner peripheral surface 23A of the cylinder portion 23 which is located at the lower right position as shown in FIG. 3. Accordingly, as shown in FIG. 3, a crescent-shaped space is formed between the outer peripheral surface 27B of the rotor 27 and the inner peripheral surface 23A of the cylinder portion 23.

The rotor 27 is provided with plural (five in this embodiment) vanes 28 for sectioning the crescent-shaped space. The vane 28 is formed like a plate, and the length of the vane 28 in the front-and-rear direction is set to be substantially equal to the distance between the confronting inner surfaces of the two side plates 25, 26 as in the case of the rotor 27. These vanes 28 are disposed to freely protrude from and retract into the guide grooves 27C provided to the rotor 27. Each vane 28 protrudes outwards along the guide groove 27C by centrifugal force in connection with the rotation of the rotor 27, and the tip thereof is brought into contact with the inner peripheral surface 23 of the cylinder portion 23. Accordingly, the crescent-shaped space described above is sectioned into five compression chambers P which are surrounded by the respective adjacent two vanes 28, 28, the outer peripheral surface 27B of the rotor 27 and the inner peripheral surface 23A of the cylinder portion 23. In connection with the rotation of the rotor 27 in the direction of the arrow R which is caused by the rotation of the output shaft 12, these compression chambers P rotate in the same direction, and the volume thereof increases in the neighborhood of the opening 23B while the volume thereof decreases at the discharge port 23C. That is, through the rotation of the rotor 27 and the vanes 28, air sucked from the opening 23B into one compression chamber P is compressed and discharged from the discharge port 23C while circulating in connection with the rotation of the rotor 27.

In this construction, the cylinder portion 23 is formed in the casing body 22 so that the axial center X2 of the cylinder portion 23 is eccentrically displaced to the upper left side with respect to the rotational center X1 as shown in FIG. 2. Therefore, in the casing body, a large space can be secured in the opposite direction to the eccentric displacement direction of the cylinder portion 23, and an expansion chamber 33 intercommunicating with the discharge ports 23C, 22C is formed along the peripheral edge portion of the cylinder portion 23 at this space.

The expansion chamber 33 is formed as a large closed space which expands along the peripheral edge portion of the cylinder portion 23 from the lower side of the cylinder portion 23 to the upper side of the output shaft 12, and intercommunicates with an exhaust port 24A formed in the pump cover 24. The compressed air flowing into the expansion chamber 33 expands and disperses in the expansion chamber 33, impinges against the partition wall of the expansion chamber 33 and irregularly reflects from the partition wall. Accordingly, the sound energy of the compressed air is attenuated, so that noise and vibration occurring when the compressed air is exhausted can be reduced. In this embodiment, an exhaust passage 37 is configured to have the discharge ports 22C, 23C formed in the casing body 22 and the cylinder portion 23 respectively, the expansion chamber 33 and the exhaust port 24A.

In this embodiment, the cylinder portion 23 is disposed to be eccentrically displaced from the rotational center X1 of the rotor 27, whereby a large space can be secured at the peripheral edge portion at the rotational center X1 side of the cylinder portion 23 in the casing body 22. Therefore, the expansion chamber 33 can be integrally formed in the casing body 22 by forming the large expansion chamber 33 in this space, so that it is unnecessary to provide the expansion chamber 33 at the outside of the casing body 22 and the casing body 22 can be miniaturized, and further the vacuum pump 1 can be miniaturized.

The pump cover 24 is disposed on the front-side side plate 26 through the seal ring 26A, and fixed to the casing body 22 by bolts 66. As shown in FIG. 2, a seal groove 22D is formed on the front surface of the casing body 22 so as to surround the cylinder portion 23 and the expansion chamber 33, and an annular seal member 67 is disposed in the seal groove 22D. The pump cover 24 is provided with an exhaust port 24A at the position corresponding to the expansion chamber 33. The exhaust port 24A serves to discharge the air flowing in the expansion chamber 33 to the outside of the machine (the outside of the vacuum pump 1), and a check valve 29 for preventing flowback of air from the outside of the machine into the pump is secured to the exhaust port 24A.

As described above, the vacuum pump 1 is constructed by connecting the electric motor 10 and the pump body 20, and the rotor 27 connected to the output shaft 12 of the electric motor 10 and the vanes 28 slide in the cylinder portion 23 of the pump body 20. Therefore, it is important to assemble the pump body 20 in conformity with the rotational center X1 of the output shaft 12 of the electric motor 10.

Therefore, in this embodiment, the electric motor 10 has the fitting bore portion 63 which is formed at one end side of the case 11 with the rotational center X1 of the output shaft 12 at the center thereof. Furthermore, as shown in FIG. 2, a cylindrical fitting portion 22F which projects rearwards around the cylinder chamber S is formed integrally with the back surface of the casing body 22. The fitting portion 22F is formed concentrically with the rotational center X1 of the output shaft 12 of the electric motor 10, and configured to have such a diameter that the fitting portion 22F is faucet-fitted to fitting bore portion 63 of the electric motor 10.

Therefore, in this construction, centering can be simply performed by merely fitting the fitting portion 22F of the casing body 22 into the fitting bore portion 63 of the electric motor 10, and an assembling work for the electric motor 10 and the pump body 20 can be easily performed. Furthermore, a seal groove 22E is formed around the fitting portion 22F on the back surface of the casing body 22, and an annular seal member 35 is disposed in the seal groove 22E.

Next, a connection structure for the rotor 27 and the output shaft 12 will be described.

A male screw (not shown) is formed on the tip portion 12A of the output shaft 12, and this male screw is engaged with a female screw (not shown) which is formed at a part of the shaft hole 27A penetrating through the rotor 27 in the axial direction thereof, whereby the output shaft 12 and the rotor 27 are connected to each other to be integrally rotatable. Furthermore, a nut 70 is engaged with the male screw of the output shaft 12 at the tip (side plate 26) side of the rotor 27, thereby restricting movement of the rotor 27 to the tip side of the output shaft 12.

Figure 4:
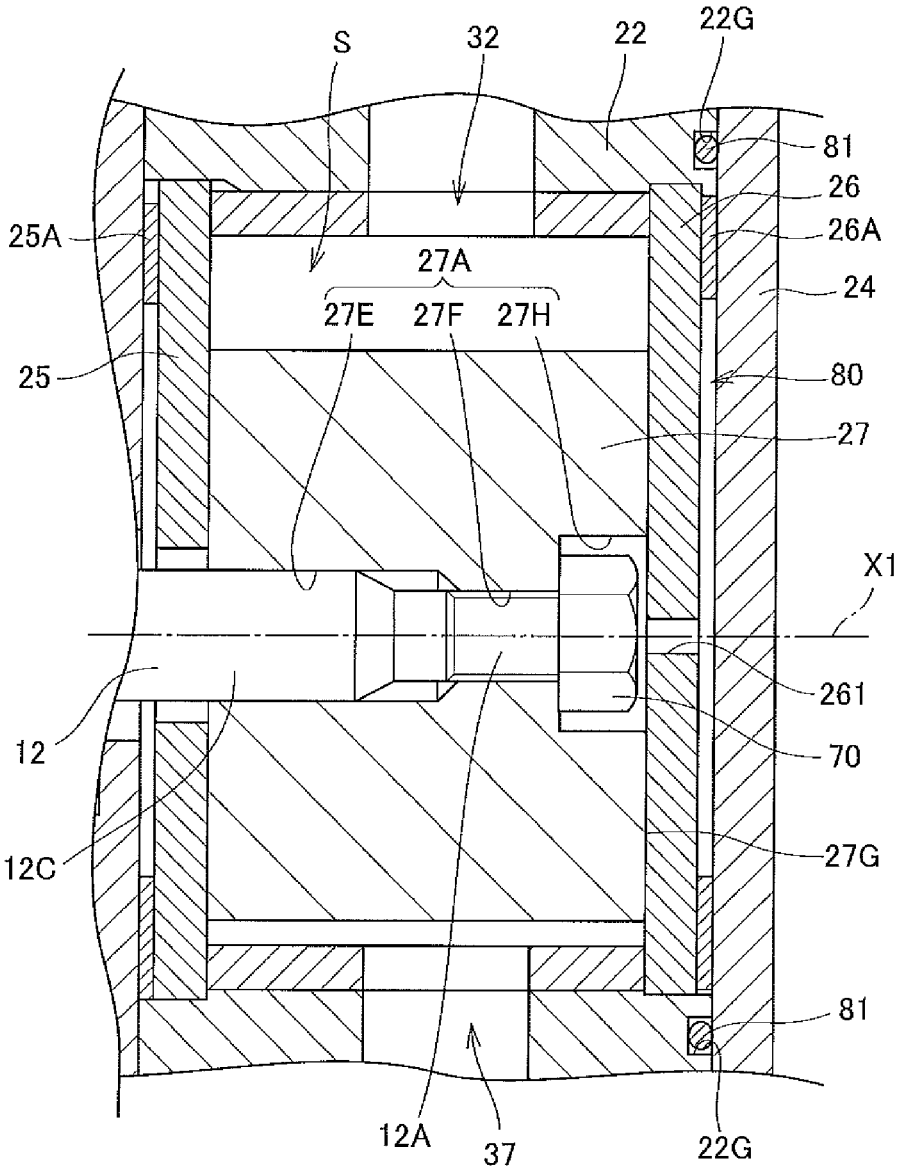
FIG. 4 is a partially enlarged view of FIG. 2.

As shown in FIG. 4, the output shaft 12 is formed so that the tip portion 12A thereof is smaller in diameter than the base portion 12C thereof, and a male screw is formed on the outer peripheral surface of the diameter-reduced tip portion 12A.

On the other hand, the shaft hole 27A of the rotor 27 has a shaft holding portion 27E in which the base portion 12C of the output shaft 12 is fitted, a hole portion 27F smaller in diameter than the shaft holding portion 27E and a recess portion 27H larger in diameter than the hole portion 27F and the shaft holding portion 27E, and a female screw is formed on the inner peripheral surface of the hole portion 27F. The shaft holding portion 27E is formed to be longer in the shaft direction than the hole portion 27F having the female screw, and specifically it is longer than the half of the whole length of the rotor 27. The shaft holding portion 27E is formed to be substantially equal in diameter to the base portion 12C of the output shaft 12. Accordingly, the rotor 27 is fitted to the base portion 12C of the output shaft 12 over the half of the whole length or more, and thus the rotor 27 is prevented from being tilted.

The recess portion 27H is opened to the front end surface 27G of the rotor 27, the tip portion of the male screw of the output shaft 12 extends into the recess portion 27, and the nut 70 is engaged with the male screw in the recess portion 27H. In this embodiment, the length of the shaft end of the output shaft 12 extending to the inside of the recess portion 27H and the thickness of the nut 70 are set to be substantially equal to or slightly smaller than the depth of the recess portion 27H, whereby the output shaft 12 and the nut 70 are prevented from protruding from the front end face 27G of the rotor 27. Furthermore, the inner diameter of the recess portion 27H is set to such a size that the nut 70 disposed in the recess portion 27H can be fastened by a tool (for example, socket wrench or the like).

In this construction, the female screw of the rotor 27 and the female screw of the nut 70 are engaged with the male screw of the output shaft 12, whereby the rotor 27 and the nut 70 exercise a so-called double nut effect. Therefore, the rotor 27 is restricted from moving in the radial direction and the thrust direction with respect to the output shaft 12, whereby the contact between the rotor 27 and the side plates 25, 26 can be prevented with a simple construction, and abrasion of the rotor 27 and the side plates 25, 26 can be suppressed and the durability of the vacuum pump 1 can be enhanced.

Furthermore, in this construction, the male screw of the output shaft 12 is formed as a left-hand screw (reverse screw), and the rotor 27 is connected to the output shaft 12 by rotating the rotor 27 in the same direction as the output shaft 12 (counterclockwise) when the pump is viewed from the front side. In this construction, force acts on the rotor 27 in such a direction that the rotor 27 is screwed into the output shaft 12 every time the vacuum pump 1 is stopped, and thus the rotor 27 and the nut 70 can be prevented from slacking in even a machine which repeats actuation and stop such as the vacuum pump 1.

In this type of vacuum pump, air in the exhaust passage 37 infiltrates into the space 80 formed between the side plate 26 at the front side and the pump cover 24 through the gap between the casing body 22 and the pump cover 24, so that the space 80 is set to the atmospheric pressure. Furthermore, the shaft hole 27A of the rotor 27 facing the side plate 26 intercommunicates with the space (the air-intake passage 32) under negative pressure occurring during operation of the vacuum pump 1 through the gap between the rotor 27 and the side plate 26, whereby the inside of the shaft hole 27A is set to the atmospheric pressure or less (that is, the negative pressure).

Since the side plate 26 is formed of a material having low rigidity such as carbon or the like in this construction, the side plate 26 slacks due to the pressure difference, and the rotor 27 and the side plate 26 come into contact with each other during operation of the vacuum pump 1. Therefore, there may occur a problem that the side plate 26 is worn away and thus the durability of the vacuum pump 1 is degraded.

Accordingly, according to this construction, an intercommunication port 261 which faces the shaft hole 27A of the rotor 27 and intercommunicates with the space 80 between the side plate 26 and the pump cover 24 is provided to the side plate 26 disposed between the rotor 27 and the pump cover 24. The intercommunication port 261 may be configured in such a size that the shaft hole 27A and the space 80 intercommunicate with each other and the pressure difference between the shaft hole 27A and the space 80 can be eliminated. In this embodiment, the intercommunication port 261 is configured to be smaller than the shaft diameter of the tip portion 12A of the output shaft 12.

According to this construction, the pressure difference between the shaft hole 27A of the rotor 27 and the space 80 can be suppressed. Therefore, even when the side plate 26 is formed of a material having low rigidity such as carbon or the like, the side plate 26 can be prevented from slacking due to the pressure difference, and thus the contact between the rotor 27 and the side plate 26 can be prevented, whereby the abrasion of the rotor 27 and the side plate 26 can be suppressed and the durability of the vacuum pump 1 can be enhanced.

Here, the volume of the space 80 is extremely smaller than that of the cylinder chamber S. Therefore, even when the size of the intercommunication port 261 is smaller than the shaft diameter of the tip portion 12A of the output shaft 12, the pressure difference between the shaft hole 27A of the rotor 27 and the space 80 can be rapidly eliminated. On the other hand, when the intercommunication port 261 is formed to be larger than the shaft diameter of the tip portion 12A of the output shaft 12, excessive air flows from the space 80 through the intercommunication port 261 into the cylinder chamber S, and thus it is assumed that the performance of the vacuum pump degrades due to reduction of the compressibility.

Accordingly, in this embodiment, the size of the intercommunication port 261 is set to be smaller than the shaft diameter of the tip portion 12A of the output shaft 12, whereby the pressure difference between the shaft hole 27 of the rotor 27 and the space 80 can be quickly eliminated, and the reduction of the compressibility when the rotor 27 is rotated can be prevented, so that the performance of the vacuum pump 1 can be prevented from being degraded.

Figure 5:
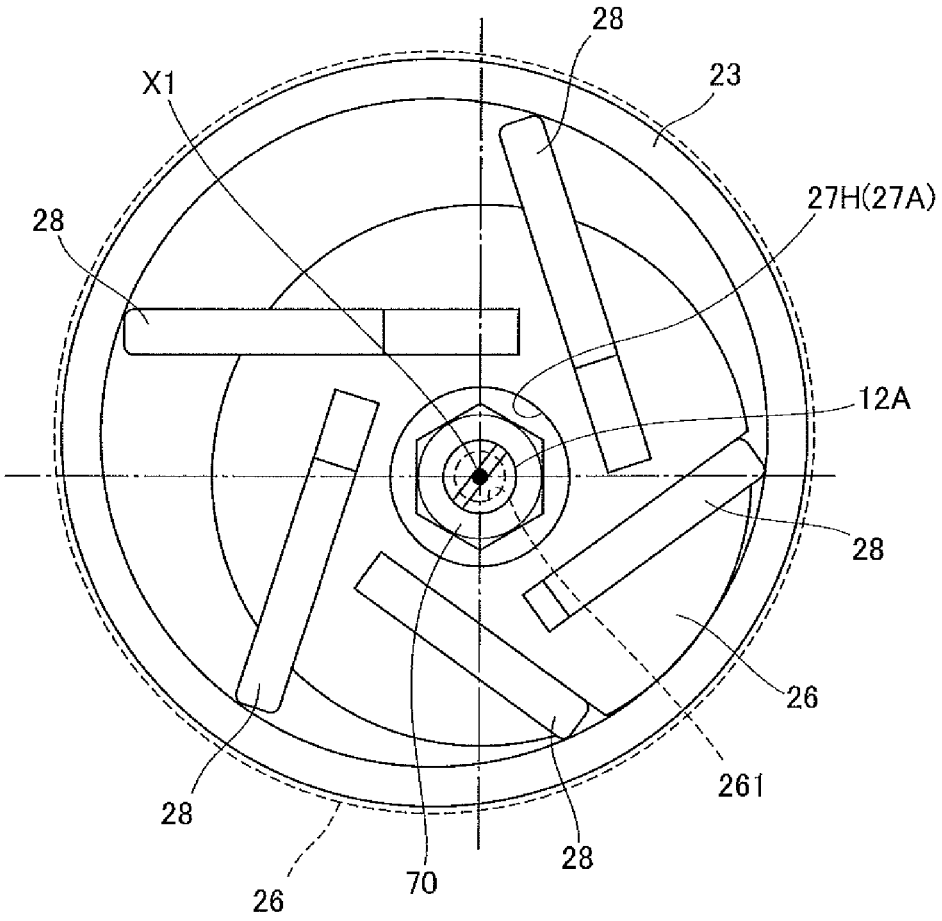
FIG. 5 is a diagram showing the relationship between the shaft center of the rotor and the side plate.

As shown in FIG. 5, the intercommunication port 261 is formed on the axial center of the shaft hole 27A of the rotor 27, that is, on the rotational center X1. In FIG. 5, the side plate 26 is illustrated by a broken line for convenience of description. The rotor 27 rotates based on the rotational center X1 together with the output shaft 12, and the rotational center X1 axis corresponds to the position which has the lowest influence on the compression and expansion when the rotor 27 is rotated. Accordingly, by forming the intercommunication port 261 on the axial center of the shaft hole 27A of the rotor 27, the reduction of the compressibility when the rotor 27 is rotated can be further prevented and the degradation of the performance of the vacuum pump 1 can be prevented while keeping the function of eliminating the pressure difference between the shaft hole 27A of the rotor 27 and the space 80. In this embodiment, the intercommunication port 261 is formed on the axial center of the shaft hole 27A of the rotor 27. However, the present invention is not limited to this construction, and the intercommunication port 261 may be disposed within an area which confronts the recess portion 27H at the front end surface 27G side of the rotor 27.

Furthermore, in this embodiment, as shown in FIG. 4, the casing body 22 has the seal groove 22G formed around the cylinder chamber S, and a seal member 81 through which the exhaust passage 37 for exhausting air from the cylinder chamber S to the outside of the machine and the space 80 are isolated from each other is disposed in the seal groove 22G. Accordingly, the exhausted air is prevented from flowing into the space 80 by the seal member 81, and the contact between the rotor 27 and the side plate 26 can be surely prevented. Furthermore, atmospheric pressure air can be prevented from flowing back into the cylinder chamber S, and thus the performance of the vacuum pump 1 can be prevented from degrading.

The best modes for carrying out the invention has been described. However, the present invention is not limited to the above embodiment, and various modifications and alterations can be made on the basis of the technical idea of the present invention. For example, in this embodiment, the female screw formed at the shaft hole 27A of the rotor 27 and the nut 70 are engaged with the male screw provided to the tip portion 12A of the output shaft 12 to fix the rotor 27. However, the rotor 27 may be fixed by another fixing means. In this case, it is assumed that the recess portion 27H is not formed at the front end surface 27G of the rotor 27. However, in this construction, the intercommunication port 261 may be formed within an area corresponding to the shaft hole 27A.

Second Embodiment

A vacuum pump having a rotating and compressing element driven by an electric motor provided in a casing is generally known. This type of vacuum pump is used to generate vacuum for actuating a power braking device of a vehicle, for example, and vacuum can be obtained by driving the rotating and compressing element in a cylinder chamber provided to the casing.

This type of vacuum pump is configured so that the electric motor and the casing having the rotating and compressing element are connected to each other, and the rotating and compressing element connected to the rotating shaft of the electric motor slides in the cylinder chamber. Therefore, it is important to assemble the casing in conformity with the rotational center of the rotating shaft of the electric motor.

Accordingly, this applicant has proposed a vacuum pump in which a fitting bore portion having the rotational center of the rotating shaft at the center thereof is formed at one end side of the case of the electric motor, a cylindrical fitting portion protruding to the periphery of the cylinder chamber is formed on the back surface of the casing, and the fitting portion is faucet-fitted to the fitting bore portion of the electric motor, whereby the positioning can be accurately and easily performed under an assembling work (JP-A-2011-214519).

However, the above construction has a risk that when the electric motor and the casing are assembled with each other, the misalignment corresponding to the clearance of fitting tolerance between the fitting bore portion and the fitting portion occurs between the cylinder chamber and the rotating and compressing element, so that individual difference occurs in the performance of the vacuum pump. Furthermore, in this construction, the fitting bore portion is formed in the case of the electric motor, and the fitting portion is formed in the casing. Therefore, this construction has a problem that different molds are required to form these members, and thus the manufacturing cost increases.

Therefore, the present invention has been implemented in view of the foregoing situation, and has an object to provide a vacuum pump which can reduce the manufacturing cost, suppress misalignment occurring under the assembling work and exercise substantially uniform performance.

Next, a vacuum pump according to the second embodiment will be described. As in the case of the vacuum pump of the first embodiment, the vacuum pump according to the second embodiment is used for a braking device using the vacuum pump as a negative pressure source. Application of the vacuum pump according to the second embodiment is the same as the first embodiment described above, and the description thereof is omitted.

Figure 6:
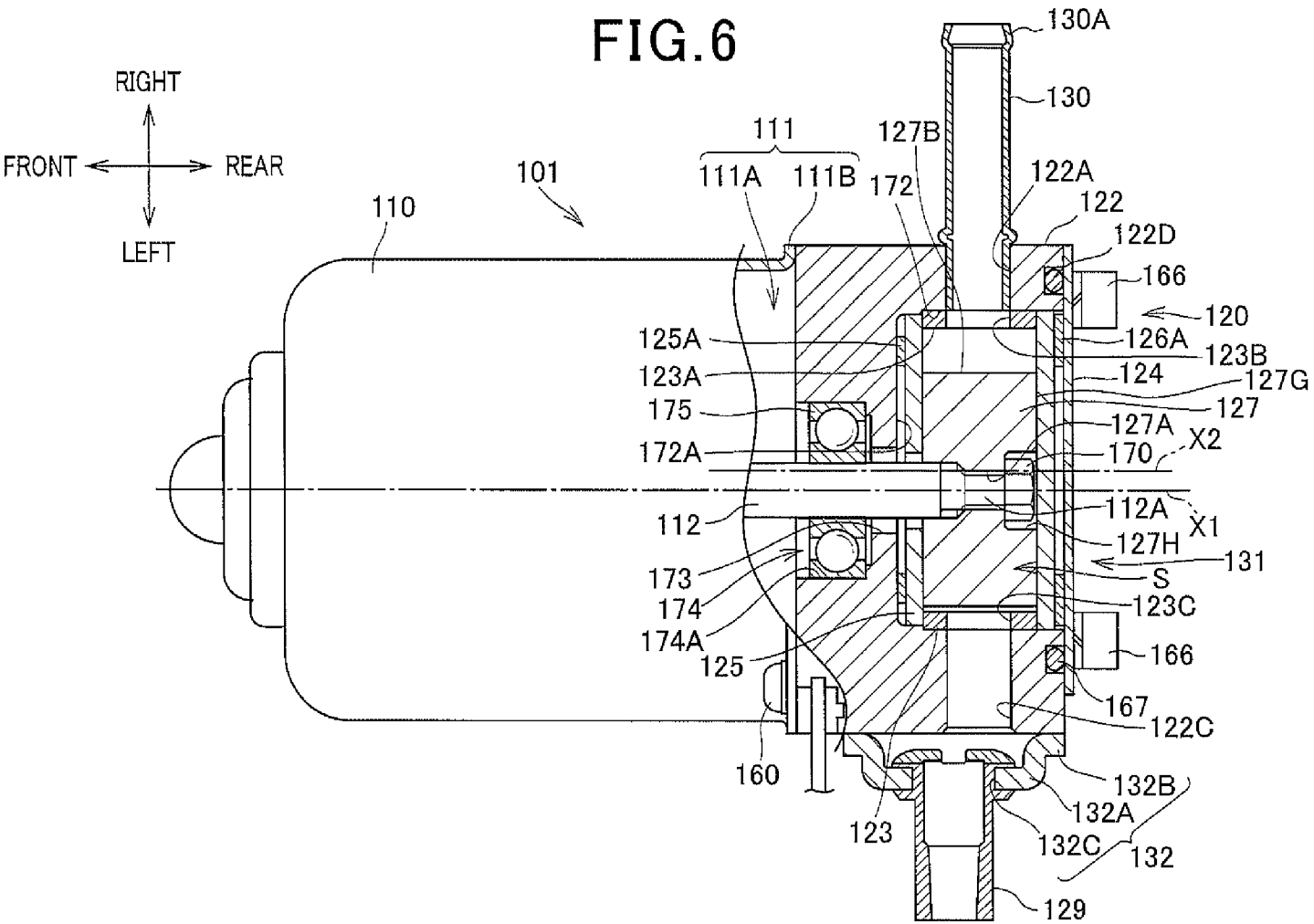
FIG. 6 is a partially sectional view of a side portion of the vacuum pump according to a second embodiment.
Figure 7:
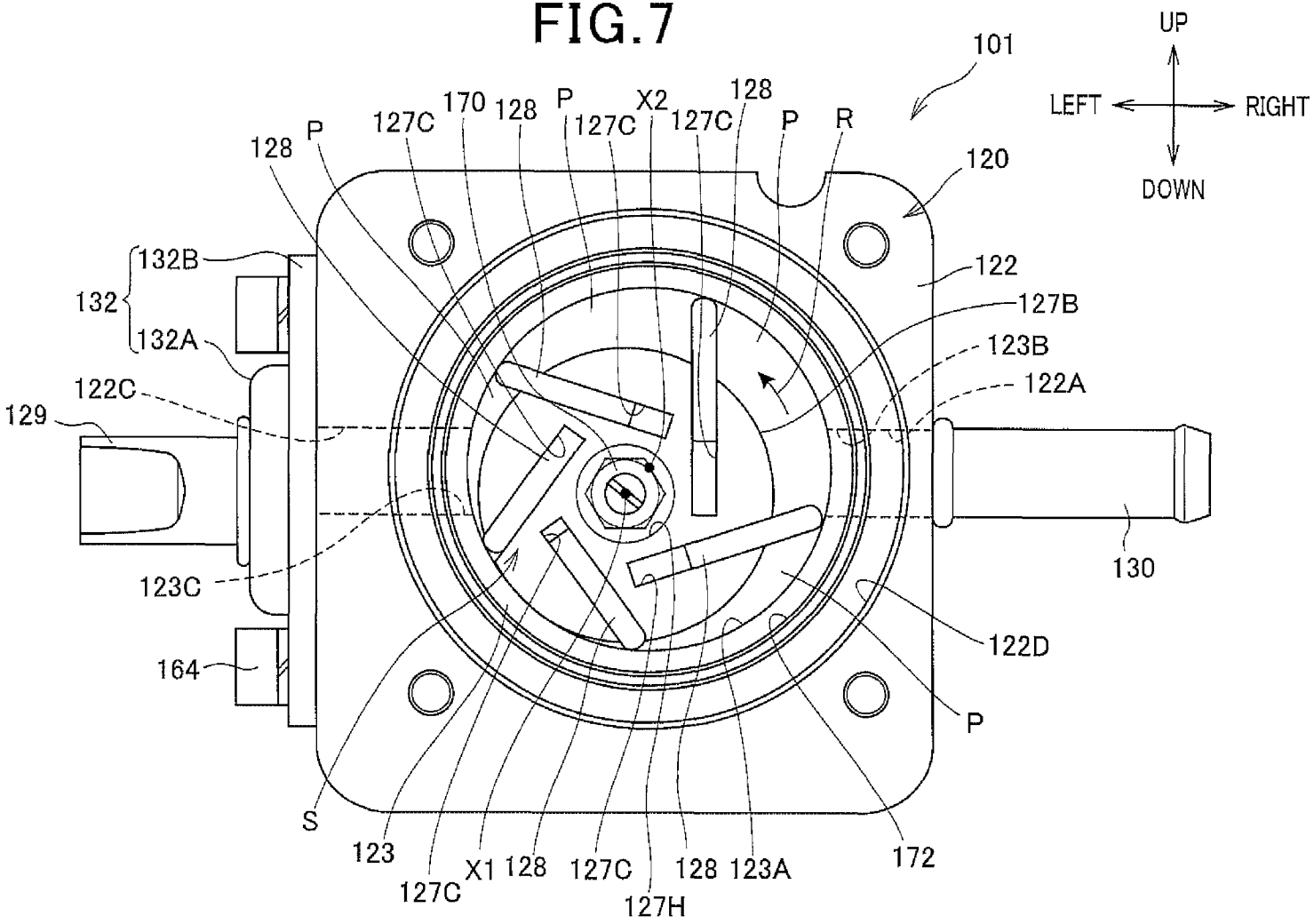
FIG. 7 is a diagram showing the vacuum pump when the vacuum pump is viewed from the rear side thereof.

FIG. 6 is a partially sectional view of the side portion of a vacuum pump 101, and FIG. 7 is a view of the vacuum pump 101 when the vacuum pump 101 is viewed from the rear side. However, FIG. 7 shows a state that members such as a pump cover 124, a side plate 126, etc. are detached to show the construction of the cylinder chamber S. In the following description, the directions represented by arrows at the upper portion of FIGS. 6 and 7 represent upper, lower, front, rear, right and left sides of the vacuum pump 101 for convenience of description. The front-and-rear direction is also referred to as "axial direction", and the right-and-left direction is also referred to as "width direction".

As shown in FIG. 6, the vacuum pump 101 has an electrical motor 110, and a pump body 120 operated by the electric motor 110 as a driving source. The electric motor 110 and the pump body 120 are fixed and supported in a vehicle body such as a car or the like while connected integrally with each other.

The electric motor 110 has an output shaft (rotating shaft) 112 extending from the substantially center portion of one end portion (rear end) of a substantially cylindrical motor case body 111 to the pump body 120 side (rear side). The output shaft 112 functions as a driving shaft for driving the pump body 120, and rotates around the rotational center X1 extending in the front-and-rear direction. A male screw which is threadably fitted to a screw hole provided to the rotor 127 of the pump body 120 is formed at the tip portion 112A of the output shaft 112, and the output shaft 112 and the rotor 127 are connected to each other to be integrally rotatable. Furthermore, in this embodiment, a nut 170 is engaged with the male screw of the output shaft 112 at the tip side of the rotor 127, thereby restricting movement of the rotor 127 to the tip side of the output shaft 112.

When the electric motor 110 is powered by a power source (not shown), the output shaft 112 rotates in the direction of an arrow R (counterclockwise) in FIG. 7, whereby the rotor 127 is rotated in the same direction (the direction of the arrow R) around the rotational center X1.

The motor case body 111 is configured in a substantially cylindrical shape having a bottom to have an opening portion 111A at one end thereof, the opening portion 111A side thereof is fixed to the pump body 120. Specifically, the motor case body 111 has a flange portion 111B which is integrally formed by bending the peripheral edge of the opening portion 111A outwards, and the flange portion 111B is fixed to the pump body 120 by screws 160.

As shown in FIG. 6, the pump body 120 has a casing body 122 secured to the flange portion 111B formed at the rear side of the motor case body 111 of the electric motor 110, a cylinder liner 123 which is press-fitted in the casing body 122 to form the cylinder chamber S, and a pump cover 124 which covers the casing body 122 from the rear side. In this embodiment, the casing 131 of the vacuum pump 101 is configured to have the casing body 122, the cylinder liner 123 and the pump cover 124.

The casing body 122 is formed of metal material having high thermal conductivity such as aluminum or the like, and configured in a substantially rectangular shape to be longer in the up-and-down direction with the rotational center X1 located substantially at the center when it is viewed from the rear side as shown in FIG. 7. An intercommunication hole 122A which intercommunicates with the inside of the cylinder S provided to the casing body 122 is formed at one side surface (right side surface) portion of the casing body 122, and a vacuum suction nipple 130 is press-fitted in the intercommunication hole 122A. As shown in FIG. 6, the vacuum suction nipple 130 is a straight pipe extending outwards in the width direction, and a pipe or tube for supplying negative-pressure air from external equipment (for example, the vacuum tank 7 (see FIG. 1)) is connected to one end 130A of the vacuum suction nipple 130.

The casing body 122 has a bore portion 172 which extends from the rear end (open end) to some point of the front side based on the axial center X2 extending in the front-and-rear direction, and a cylindrical cylinder liner 123 is press-fitted in the bore portion 172. It is needless to say that the cylinder liner 123 is not press-fitted in the bore portion 172, but fitted in the bore portion 172.

The axial center X2 is parallel to the rotational center X1 of the output shaft 112 of the electric motor 110, and eccentrically displaced from the rotational center X1 to the upper right side as shown in FIG. 6. In this construction, the axial center X2 is eccentrically displaced so that the outer peripheral surface 127B of the rotor 127 having the rotational center X1 at the center thereof makes contact with the inner peripheral surface 123A of the cylinder liner 123 formed based on the axial center X2.

The cylinder liner 123 is formed of the same metal material (iron in this embodiment) as the rotor 127. In this construction, the cylinder liner 123 and the rotor 127 have the same thermal expansion coefficient. Therefore, the contact between the outer peripheral surface 127B of the rotor 127 and the inner peripheral surface 123A of the cylinder liner 123 when the rotor 127 is rotated can be prevented irrespective of temperature variation of the cylinder liner 123 and the rotor 127. When the cylinder liner 123 and the rotor 127 may be formed of different materials insofar as these materials have substantially the same level thermal expansion coefficients.

Since the cylinder liner 123 can be accommodated within the length range in the front-and-rear direction of the casing body 122 by press-fitting the cylinder liner 123 into the bore portion 172 formed in the casing body 122, the cylinder liner 123 can be prevented from protruding from the casing body 122, and the casing body 122 can be miniaturized.

Furthermore, the casing body 122 is formed of a material having higher thermal conductivity than the rotor 127. Accordingly, heat occurring when the rotor 127 and the vanes 128 are rotationally driven can be quickly transferred to the casing body 122, and thus heat can be sufficiently radiated from the casing body 122.

An air intake port 123B through which the intercommunication hole 122A of the casing body 122 and the cylinder chamber S intercommunicate with each other is formed in the cylinder liner 123, air passing through the vacuum suction nipple 130 is supplied through the intercommunication hole 122A and the air intake port 123B into the cylinder chamber S. Discharge ports 122C, 123C which penetrate through the casing body 122 and the cylinder liner 123 and through which air compressed in the cylinder chamber S is discharge are formed at the other side surface (left side surface) portion side of the casing body 122 in the casing body 122 and the cylinder liner 123. The discharge ports 122C, 123C are formed on the same axis as the intercommunication hole 122A and the air intake port 123B.

Side plates 125, 126 which block the opening of the cylinder chamber S are disposed at the front end and rear end of the cylinder liner 123, respectively. The diameters of these side plates 125, 126 are set to be larger than the inner diameter of the inner peripheral surface 123 of the cylinder linear 123, and urged to be pressed against the front end and rear end of the cylinder liner 123 by seal rings 125A, 126A, respectively. Accordingly, the cylinder chamber S which is hermetically closed except for the air intake port 123B intercommunicating with the vacuum suction nipple 130 and the discharge ports 123C, 122C is formed inside the cylinder liner 123.

In this embodiment, the side plate 126 at the electric motor 110 side is disposed at the terminal of the bore portion 172, and pinched through a sealing ring 126A between the wall portion 172A of the bore portion 172 and the cylinder liner 123.

The rotor 127 is disposed in the cylinder chamber S. The rotor 127 has a circular cylindrical shape extending along the rotational center X1 of the electric motor 110, and has a shaft hole 127A to which the output shaft 112 as the driving shaft of the pump body 120 is threadably fitted. In addition, plural guide grooves 127C are provided to be far away radially from the shaft hole 127A and spaced from one another at equiangular intervals in the peripheral direction around the shaft hole 127A. As shown in FIG. 6, a recess portion 127H is formed at the end face (so-called rear end face) 127G at the side of the rotor 127 which confronts the pump cover 124, and the nut 70 is threadably fitted to the male screw of the output shaft 112 in the recess portion 127H. In this embodiment, the length of the shaft end of the output shaft 112 extending in the recess portion 127H and the thickness of the nut 170 are set to be substantially equal to or slightly smaller than the depth of the recess portion 127H respectively, so that the output shaft 112 and the nut 170 are prevented from protruding from the rear end face 127G of the rotor 127.

The length in the front-and-rear direction of the rotor 127 is set to be substantially equal to the length of the cylinder chamber S of the cylinder liner 123, that is, the distance between the confronting inner surfaces of the two side plates 125, 126, and the gap between the rotor 127 and the side plates 125, 126 is substantially closed.

The outer diameter of the rotor 127 is set so that the outer peripheral surface 127B of the rotor 127 keeps a minute clearance from a portion located at a lower left side out of the inner peripheral surface 123A of the cylinder liner 123 as shown in FIG. 7. Accordingly, as shown in FIG. 7, a crescent-shaped space is formed between the outer peripheral surface 127B of the rotor 127 and the inner peripheral surface 123A of the cylinder liner 123.

Plural (five in this embodiment) vanes 128 for sectioning the crescent-shaped space are provided to the rotor 127. The vane 128 is configured like a plate, and the length thereof in the front-and-rear direction is set to be substantially equal to the distance between the mutually confronting inner surfaces of the two side plates 125, 126 as in the case of the rotor 127. These vanes 128 are disposed to freely protrude from and retract into the guide grooves 127C provided to the rotor 127. Each vane 128 protrudes outwards along the guide groove by centrifugal force thereof in connection with the rotation of the rotor 127, and the tip thereof abuts against the inner peripheral surface 123A of the cylinder liner 123. Accordingly, the crescent-shaped space is sectioned into five compression chambers P surrounded by the respective adjacent two vanes 128, 128, the outer peripheral surface 127B of the rotor 127 and the inner peripheral surface 123A of the cylinder liner 123. In connection with the rotation of the rotor 127 in the direction of the arrow R which is caused by the rotation of the output shaft 112, these compression chambers P rotate in the same direction, and the volume thereof increases in the neighborhood of the air intake port 123B while the volume thereof decreases at the discharge port 123C. That is, through the rotation of the rotor 127 and the vanes 128, air sucked from the air intake port 123B into one compression chamber P is compressed and discharged from the discharge port 123C while going around in connection with the rotation of the rotor 127.

An exhaust portion 132 is secured to the left side surface of the casing body 122 having the discharge port 122C formed therein so as to surround the discharge port 122C. The exhaust portion 132 has an expansion portion 132A which expands outwards in the width direction substantially at the center thereof, and a peripheral edge portion 132B which is provided around the expansion portion 132A and comes in close contact with the left side surface of the casing body 122, and the peripheral edge portion 132B is secured to the casing body 122 by screws 164. An exhaust port 132C through which air discharged from the discharge port 123C is discharged to the outside of the machine (the outside of the vacuum pump 101) is provided to the expansion portion 132A, and a check valve 129 is secured to the exhaust port 132C to prevent flowback of the air from the outside of the machine to the pump.

The pump cover 124 is disposed on the side plate 126 at the front side through a seal ring 126A, and fixed to the casing body 122 by bolts 166. As shown in FIG. 6, a seal groove 122D is formed on the rear end face of the casing body 122 so as to surround the cylinder liner 123, and an annular seal member 167 is disposed in the seal groove 122D.

As described above, the vacuum pump 101 is constructed by connecting the electric motor 110 and the pump body 120, and the rotor 127 connected to the output shaft 112 of the electric motor 110 and the vanes 128 slide in the cylinder liner 123 of the pump body 120. Therefore, it is important to assemble the pump body 120 in conformity with the rotational center X1 of the output shaft 112 of the electric motor 110.

In this embodiment, a through hole 173 through which the output shaft 112 penetrates, and an annular bearing holding portion 174 provided around the through hole 173 are formed substantially at the center of a face of the casing body 122 to which the electric motor 110 is secured, and the outer ring of a bearing (bearing portion) 175 for supporting the output shaft 112 is held on the inner peripheral surface 174A of the bearing holding portion 174. The through hole 173 and the bearing holding portion 174 are formed so that the rotational center X1 is set at the center thereof, and formed in the casing body 122 integrally with the bore portion 172 in which the cylinder liner 123 is press-fitted. Accordingly, when the bore portion 172 and the bearing holding portion 174 of the casing body 122 are provided with the cylinder liner 123 and the bearing 175 respectively, the positional relationship between the bearing 175 based on the rotational axis X1 and the cylinder liner 123 based on the axial center X2 can be regulated in the casing body 122. Therefore, a misalignment occurring when the motor case body 111 of the electric motor 110 is assembled with the casing body 122 can be suppressed, and the assembled vacuum pump 101 can exercise substantially uniform performance having little individual difference.

Furthermore, the casing body 122 can be formed by using a single mold, so that the number of parts can be reduced and thus the manufacturing cost can be reduced.

Figure 8:
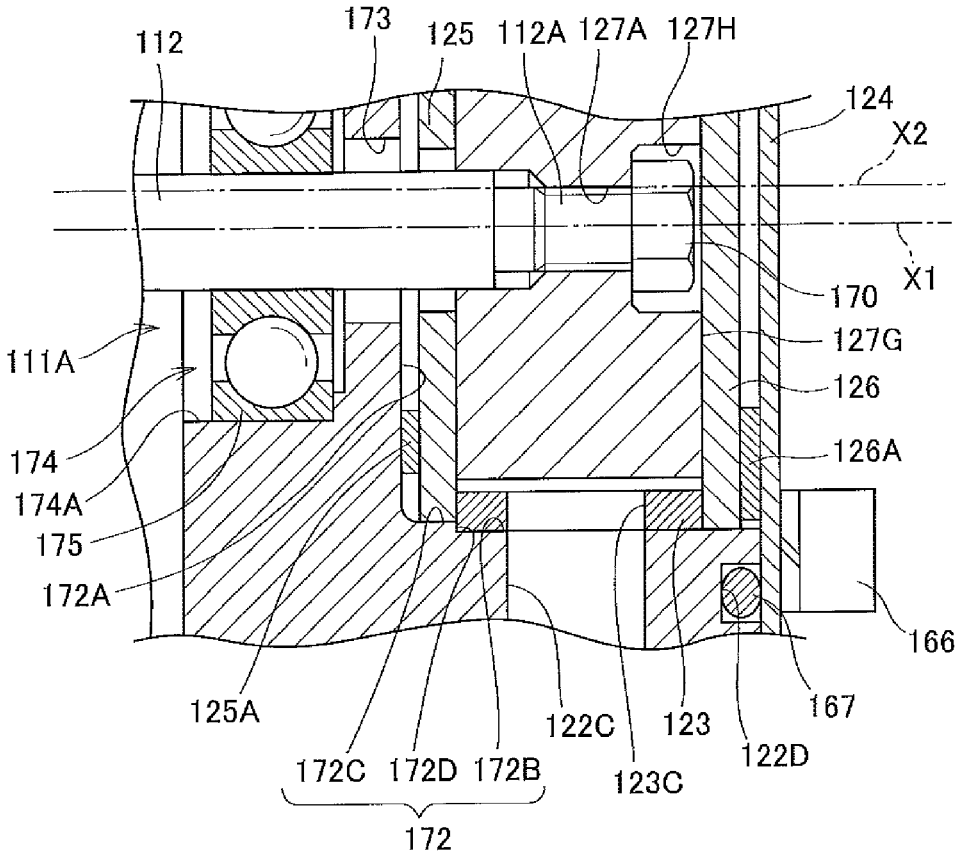
FIG. 8 is a partially enlarged view of FIG. 6.

FIG. 8 is a partially enlarged view of FIG. 6.

As described above, the cylinder liner 123 is press-fitted in the bore portion 172 formed in the casing body 122. In this construction, the bore portion 172 is formed as a stepped bore which decreases in diameter from the rear end (open end) of the casing body 122 to the depth side (wall portion 72A) of the casing body 122, and has a liner holding portion 172B in which the cylinder liner 123 is held, a diameter-reduced portion 172C which is smaller in diameter than the liner holding portion 172B and in which the side plate 126 is disposed, and a step portion 172D formed between the liner holding portion 172B and the diameter-reduced portion 172C.

Accordingly, the press-fitting work of the cylinder liner can be easily and accurately performed by press-fitting the cylinder liner 123 so that the cylinder liner 123 abuts against the step portion 172D.

Furthermore, the bore diameter of the diameter-reduced portion 172C is set to be larger than the inner diameter of the cylinder liner 123, and thus the side plate 126 which is larger than the inner diameter of the cylinder liner 123 can be disposed at the diameter-reduced portion 72C, so that the opening of the cylinder liner 123 can be simply blocked by the side plate 126.

The best modes for carrying out the present invention have been described. However, the present invention is not limited to the above embodiments, and various modifications and alterations can be made on the basis of the technical idea of the present invention.

DESCRIPTION OF REFERENCE NUMERALS

1 vacuum pump
6 brake booster (power braking device)
7 vacuum tank
9 brake pipe
10 electric motor (driving machine)
11 case
12 output shaft (rotating shaft)
12A tip portion
22 casing body
22G seal groove
23 cylinder portion
25 side plate
26 side plate
27 rotor
27A shaft hole
27D shaft holding portion
27 rotor
27A shaft hole
27E shaft holding portion
27F hole portion
27G front end face
27H recess portion
28 vane
70 nut
80 space (space between side plate and pump cover)
81 seal member
100 brake device
261 intercommunication port
101 vacuum pump
110 electric motor (motor)
111 motor case
111A opening portion
112 output shaft (rotating shaft)
122 casing body
123 cylinder liner
127 rotor (rotating and compressing element)
128 vane (rotating and compressing element)
131 casing
172 bore portion
172C diameter-reduced portion

174 bearing holding portion

175 bearing (bearing portion)

What is claimed is:

1. A vacuum pump comprising:

a casing body having a hollow cylinder chamber opened at an end portion thereof, a rotor rotated in the hollow cylinder chamber, an air-intake passage through which air to be compressed in connection with the rotation of the rotor is supplied into the hollow cylinder chamber, a discharge port through which air compressed in the hollow cylinder chamber is discharged, a side plate which blocks the opening of the hollow cylinder chamber, and a pump cover which is disposed at the opposite side to the rotor so as to sandwich the side plate between the pump cover and the rotor and fixed to the casing body, wherein the side plate is provided with an intercommunication port that faces a shaft hole of the rotor and intercommunicates with a space between the side plate and the pump cover, and the intercommunication port intercommunicates the shaft hole of the rotor and the space between the side plate and the pump cover, the intercommunication port is formed to be smaller than a shaft diameter of a rotating shaft for rotating the rotor, and the rotating shaft is prevented from protruding from a front end face of the rotor, and wherein the air-intake passage has a lower pressure than the space between the side plate and the pump cover.

2. The vacuum pump according to claim 1, wherein the intercommunication port is formed on an axial center of the shaft hole of the rotor.

3. The vacuum pump according to claim 1, further comprising a seal member through which an exhaust passage from the hollow cylinder chamber to the outside thereof and the space are isolated from each other is disposed around the hollow cylinder chamber between the casing body and the pump cover.

4. A vacuum pump having a rotating and compressing element driven by a motor in a casing, wherein the casing has a cylinder liner that forms a hollow cylinder chamber and in which the rotating and compressing element that rotates inside the hollow cylinder chamber slides, a bearing portion for supporting a rotating shaft of the motor, and a casing body in which the cylinder liner is fitted and that is secured to a flange portion formed by bending the peripheral edge of an opening portion of a cylindrical motor case body having a bottom by a screw, wherein a side plate that blocks an opening of the cylinder chamber is positioned at an end portion of the cylinder liner, the casing body has a bore portion in which the cylinder liner is disposed, the bore portion is a stepped bore that is reduced in diameter from an open end to a depth side and has a liner holding portion in which the cylinder liner is held, a diameter-reduced portion whose bore diameter is smaller than a bore diameter of the liner holding portion and in which the side plate is disposed, and a step portion that extends inwardly in a radial direction from the liner holding portion to the diameter-reduced portion and that connects the liner holding portion and the diameter-reduced portion, the cylinder liner has an outer diameter that is larger than the bore diameter of the diameter-reduced portion, and the cylinder liner is abutted against the step portion.

5. The vacuum pump according to claim 4, wherein the bore diameter of the diameter-reduced portion of the stepped bore is larger than an inner diameter of the cylinder liner.

6. The vacuum pump according to claim 4, further comprising:

an air-intake passage that penetrates through the casing body and the cylinder liner along a radial direction of the cylinder liner, and through which air to be compressed in connection with the rotation of the rotor is supplied into the hollow cylinder chamber, and a discharge port that penetrates through the casing body and the cylinder liner along a radial direction of the cylinder liner, that is provided at a position shifted in a direction of rotation of the rotating and compressing element, and through which air compressed in the hollow cylinder chamber is discharged.

7. The vacuum pump according to claim 6, wherein the bore diameter of the diameter-reduced portion of the stepped bore is larger than an inner diameter of the cylinder liner.

8. The vacuum pump according to claim 4, wherein the casing body is formed as a single body.

9. The vacuum pump according to claim 8, wherein the casing body is secured to an opening portion of a cylindrical motor case body having a bottom, and the casing body has a bore portion in which the cylinder liner is disposed, and the bore portion is a stepped bore that is reduced in diameter from an open end to a depth side.

* * * * *